United States Patent [19]

McCrea

[11] Patent Number: 4,719,688

[45] Date of Patent: Jan. 19, 1988

[54] MANUFACTURING A PLAQUE WITH AN INSERT THEREIN

[76] Inventor: Charles McCrea, P.O. Box 149, Bohemia, N.Y. 11716

[21] Appl. No.: 932,041

[22] Filed: Nov. 18, 1986

Related U.S. Application Data

[63] Continuation-in-part of Ser. No. 817,042, Jan. 8, 1986, Pat. No. 4,655,428.

[51] Int. Cl.[4] ..... B23P 19/04

[52] U.S. Cl. ..... 29/445; 29/525; 29/564.2

[58] Field of Search ..... 29/564.2, 564.7, 56.5, 29/56.6, 26 R, 26 A, 432.2, 432.1, 445, 451, 525

[56] References Cited

U.S. PATENT DOCUMENTS

| | | | |
|---|---|---|---|
| 3,641,659 | 2/1972 | Colgan et al. | 29/564.2 |
| 3,742,591 | 7/1973 | Ritter et al. | 29/525 |
| 3,947,958 | 4/1976 | Bowers | 29/564.2 X |
| 3,962,775 | 6/1976 | King, Jr. | 29/445 |
| 3,973,313 | 8/1976 | Hunter | 29/525 X |
| 4,122,590 | 10/1978 | Spencer | 29/564.2 |

FOREIGN PATENT DOCUMENTS

| | | | |
|---|---|---|---|
| 2079717 | 1/1982 | United Kingdom | 29/564.2 |

*Primary Examiner*—William R. Briggs

*Attorney, Agent, or Firm*—Roberts, Spiecens & Cohen

[57] ABSTRACT

A method is provided for the installation of an insert in a plaque or the like. The insert is provided with a bore having a limited access such that a hook-like protrusion on a stand can be inserted into the bore whereafter the stand is rotated to bring the hook-like attachment into engagement with a socket-like arrangement included within the bore. The method involves use of successive drilling tool reciprocal movements for successively drilling a hole and then installing the insert in the hole. The method also involves orienting a series of inserts for installation by vibrating the same, culling out non-oriented inserts, and successively placing the oriented inserts on a matching projection on a slide which carries the inserts successively to installation position.

23 Claims, 15 Drawing Figures

MANUFACTURING A PLAQUE WITH AN INSERT THEREIN

OTHER APPLICATIONS

This application is a continuation-in-part of my earlier application, Ser. No. 817,042, filed Jan. 8, 1986, U.S. Pat. No. 4,655,428.

FIELD OF INVENTION

This invention relates to methods of manufacturing structures which can be braced in upright position such as, for example, plaques, photographic frames and the like planar structures. The invention also relates to the installation of inserts for articles which may be selectively suspended from a vertical wall or the like or which may be braced in upright position on a flat horizontal surface or the like.

BACKGROUND OF THE INVENTION

In the display of pictures, plaques or other similar articles that may or may not be ornamental in appearance, it is sometimes desirable to be able to place the article either on a horizontal surface, such as a desk or a wall whereat the article is braced in upright position or, in the alternative, to suspend the article from a vertical surface such as a wall.

There are numerous patents which relate to structures for supporting articles on flat surfaces which may be horizontal or vertical and which deal either exclusively with one type of surface or the other, or which deal with both types of supporting surfaces. Some of these patents include U.S. Pat. Nos. 2,992,464; 3,251,572; 3,865,342; 4,212,122; 4,229,892; and 4,441,268.

In U.S. Pat. No. 3,865,342, J. Kanzelberger discloses a support for a picture frame or the like which is capable of being hung on a wall, or which may rest on a surface. The support includes a strap having a hole in one end for providing a hanger support. The other end of the strap is adapted for being bent away from the article to be supported to give an easel-type support. Between the two ends of the strap is provided a slot for receiving a friction-holding device. The strap can be rotated off center in either clockwise or counterclockwise direction to compensate for unbalanced picture frames or plaques. The strap may also be moved relative to the fastening device to permit vertical adjustment of the strap in relation to the plaque.

In U.S. Pat. No. 4,441,268 is revealed a picture framing device embodying dovetailed elements which enable supporting a picture frame in either of two upright positions. Dovetail elements of male construction are insertable within female dovetail elements to provide a connection between the bracing device and the article to be supported.

O. Hueter shows in U.S. Pat. No. 4,229,892 a display device having a frame-holder provided with a support member. The display device can be supported as a free-standing element by engaging the support member with an adapter.

In U.S. Pat. No. 3,251,572, W. Klitzner shows a structure involving relatively few components, which structure is adapted for use by movement of an attachment which is secured to the rear of the article to be displayed. The attachment includes a support member that is mounted for slidable movement in a bracket and which has a particular construction and configuration for the location thereof in one of two positions whereby the article may be mounted on either a horizontal or a vertical surface as required.

SUMMARY OF THE INVENTION

As will be seen in the description which follows hereinafter, none of the aforegoing patents reveals a method for assembling the particular construction as in the present invention and it is an object of the present invention to provide a new and unique method for assembling an arrangement in which provision is made for mounting various plaques and the like in braced upright position on a horizontal surface or hanging from a vertical wall, or the like.

It is yet another object of the invention to provide for the installation of an improved insert in plaques and like constructions, whereby such inserts may be readily positioned by utilization of mass production techniques in accommodating bores in predetermined alignment such as to facilitate utilization thereof.

In achieving the above and other objects of the invention, there is provided an apparatus for automatically placing an insert in a body such as a plaque. This apparatus comprises a support arrangement for supporting the body at a processing station, a drill arrangement reciprocal towards and away from the body at the processing station for drilling a hole in the body, and a slide arrangement reciprocal between positions respectively intervening between the drill arrangement and the body at the processing station and removed therefrom. The slide arrangement is adapted in accordance with the invention to support the insert and is adapted to be at least in part displaced by the drill arrangement to move the insert into the hole after it is drilled whereby on sequential movements the drill arrangement drills a hole in the aforesaid body and then moves the insert into the hole.

As will be shown in greater detail hereinbelow, the slide arrangement includes a base with a member being displaceable from the base upon pressure from the drill arrangement. Further provided is a return arrangement to return the above-mentioned member to the base. As will be seen hereinbelow, the member includes pins extending slidably through the above-mentioned base and the return arrangement includes compression springs on these pins. More particularly, the pins include heads sandwiching the compression springs against the base. It will also be seen hereinbelow that the drill arrangement includes a bit and a barrel supporting the bit and shoulders on the barrel on opposite sides of the bit for engaging the above-mentioned pins.

Other features of the invention include providing a projection having a configuration which matches the internal configuration of the insert, the provision of an air jet arrangement adjacent the bit for cleaning out the hole which is drilled, and the provision of a track for guiding the base with piston and cylinder components being provided for reciprocating the base and thereby the slide arrangement between the above-mentioned positions. It will also be seen that adjustable stops are provided for limiting movement of the slide arrangement.

Still further features of the invention involve that the base is provided with a hole to accommodate the passage therethrough of the above-mentioned bit when the slide means intervenes between the above-mentioned body and the drill.

Still further features of the invention comprise the provision of a delivery arrangement for delivery of the insert to the profiled member with the opening in the insert being oriented with the projection and further the provision of a piston and cylinder arrangement to force the insert onto the projection. The insert it will be noted is configured as a hat including a brim and a crown and the delivery arrangement includes a chute provided with slots to receive diammetrically opposed portions of the brim. More particularly, the crown and brim have an opening which is partly covered to form a chordal edge and the crown is partly cut out to leave a shoulder having an angular relationship to the aforesaid edge. In accordance with the aforegoing, the delivery arrangement includes a culling rail arrangement upstream of the above-mentioned chute to allow the insert to pass when appropriately oriented and to reject the insert when it is not appropriately oriented.

As will be noted below, the delivery arrangement includes a vibrating apparatus including a vat chargeable with a plurality of inserts and having an upwardly inclined spiral path along which the inserts are directed in a crown up, rim down posture. The spiral path terminates in a tangential path passing beneath the culling rail arrangement which is thereby effected to pass and reject the inserts according to the posture thereof. As will also be seen in the Detailed Description which follows hereinbelow, there is provided an air jet to urge the inserts against the culling rail arrangement whereby the inserts are passed or rejected or urged into passable orientation by orienting the shoulders of the inserts with respect to the culling rail arrangement. It will also be noted that alternately operable piston and cylinder components are spaced along the tangential path to block the inserts and to release the foremost insert for movement into and through the chute in a sequentially-timed order. A piston and cylinder arrangement is also provided at the downstream end of the chute to position each insert relative to the slide arrangement. As a further feature of the invention, the slots of the chute are designed to be sinusoidal in configuration. The above-mentioned projection moreover has a configuration which is part of a cylinder with slots therein to receive corresponding parts of the respective inserts.

Also mentioned as coming within the scope of the invention is a method for mounting an insert in a plaque-like body or the like. This method comprises holding the body in a processing station, reciprocating a drilling tool towards and away from the body in first and second cycles, drilling a hole in the body during the first cycle, moving the insert into a position between the hole and drilling tool upon withdrawal of the tool from the hole and pressing the insert into the hole by means of the above-mentioned tool during the second cycle.

More specifically, it will be noted in the description which follows hereinbelow that the method is repeated sequentially for a plurality of bodies and inserts and that the bodies are vibrated to orient the same for substantially identical insertion into respective of the bodies. Moreover, it will be noted that the inserts are fed along an upwardly spiralling path while vibrating and orienting the same and culling out any non-oriented inserts before an attempt is made to mount the same in a body.

Still further features of the method of the invention comprise delivering inserts sequentially to a common slide and moving the slide back and forth between a first position between the tool and a hole which has been drilled by the tool and a second position remote from the tool to receive the next sequential insert. Still further included amongst the features of the invention is that the inserts are formed with a common internal asymmetrical configuration and that the projection of the slide is formed with a like configuration and that the internal configurations of sequential of the inserts are moved sequentially onto the projection.

Further features of the method of the invention comprise sliding the inserts down a chute between the upwardly spiralling path and the slide and initiating the sliding of the inserts down the chute by directing a jet of air at the same. Another feature involves forming the inserts with peripheral teeth and press-fitting the inserts into the respective holes such that the teeth engage with the surrounding portions of the body. Yet another feature is the cleaning of the holes with a jet of air before press-fitting the inserts therein.

Still further features of the invention comprise orienting the projection on the slide in a polar sense relative to the processing station so that the inserts are oriented relative to the associated bodies in a polar sense. The method of the invention further involves culling the inserts by urging the same with compressed air against a culling rail and configuring the inserts in the form of a hat having a brim and crown while forming a cut out in the crown to correspond with the culling rail. Still further, there is contemplated countersinking the holes to receive the brims whereby the inserts are fully recessed into the receiving plaques or other such bodies.

The above and other objects, advantages and features of the invention will be found in the Detailed Description which follows hereinbelow as illustrated in the accompanying drawing.

BRIEF DESCRIPTION OF DRAWING

In the drawing:

FIG. 9(*b*) shows diagrammatically and on enlarged scale a detail of a projection included in the slide arrangement of FIG. 9(*a*);

DETAILED DESCRIPTION OF DRAWING

Figure 1:
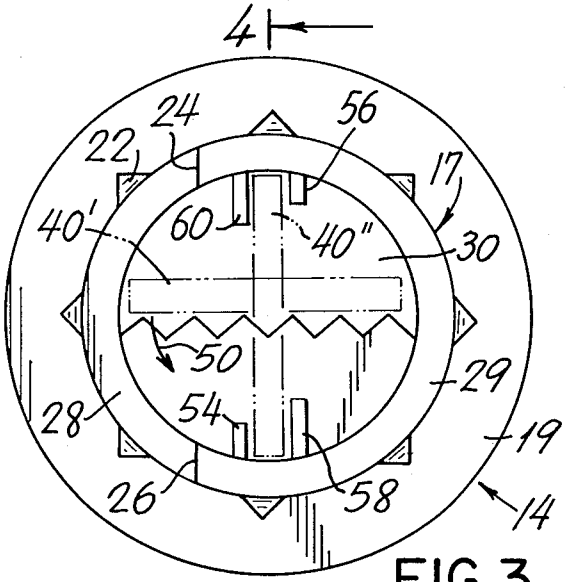
FIG. 1 is a perspective view from the rear of a plaque provided with inserts by the method of the invention.
Figure 1:
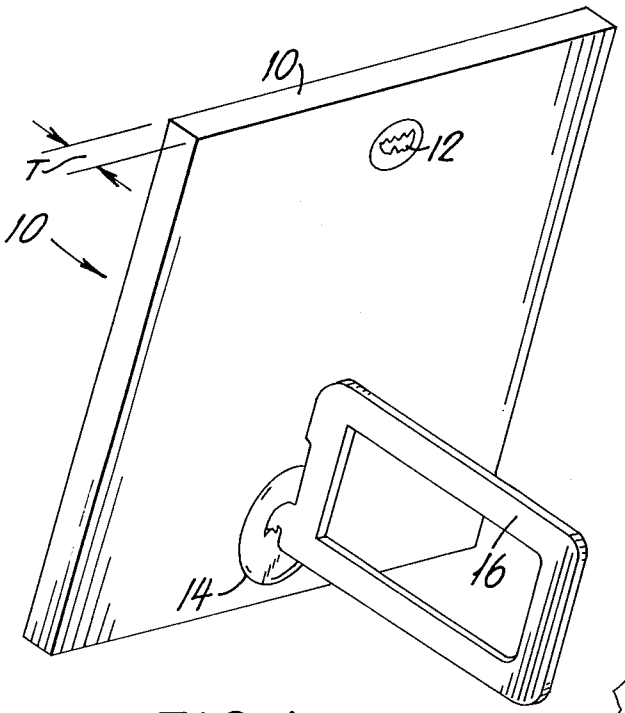

In FIG. 1 is illustrated a perspective rear view a braceable object or article 10. This braceable object may, for example, be of planar configuration. Other shapes are as well contemplated within the scope of the invention. Examples of braceable articles include plaques, picture frames, point of sale advertising boards and various other types of structures which are susceptible of being braced by easel-type bracing structures in upright attitude or posture on a horizontal surface or the like, or which may be selectively suspended by suspending devices such as hooks from vertical supporting structures such as walls, or the like. As has been indicated above, it is an object of the invention to provide for the above selective types of support as may be required while providing at the same time that the bracing structure is detachable so that the articles may be piled one on top of the other without interference from the bracing structure. The invention also provides for ease in attachment of the bracing structure and for relatively strong attachment of the same to the article to be braced so that detachment does not inadvertently occur to the distress of the user.

In FIG. 1 are furthermore seen two like inserts 12 and 14. In insert 14 has been inserted a section of the bracing structure 16. Nothing has been inserted or coupled to the insert 12 which may be utilized for hanging the article 10 from a wall. As an alternative, the article 10 may be turned upside down and a bracing structure such as indicated at 16 coupled to the same. The inserts may be of like or different sizes. Preferably, the internal and external configurations thereof are the same so that all inserts may be processed by the same equipment as will be discussed hereinbelow.

Figure 2:
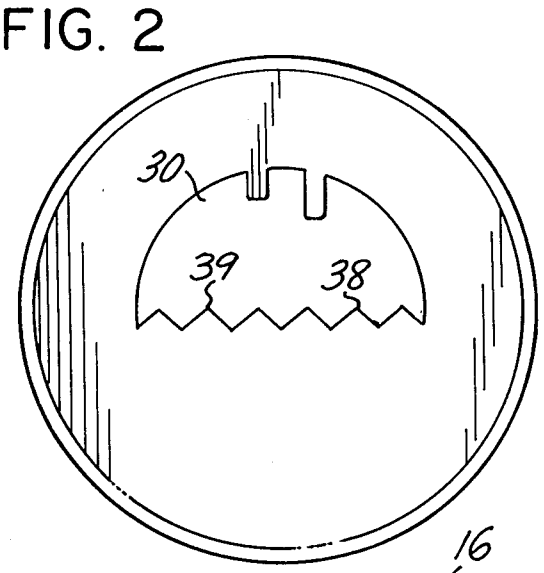
FIG. 2 is a rear view of the insert employed in the structure of FIG. 1.
Figure 3:
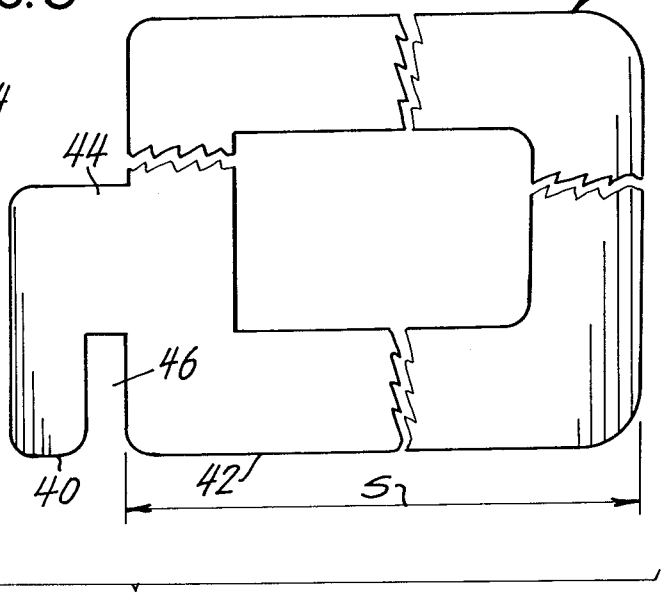
FIG. 3 is a front view of the insert illustrated in FIG. 2.
Figure 4:
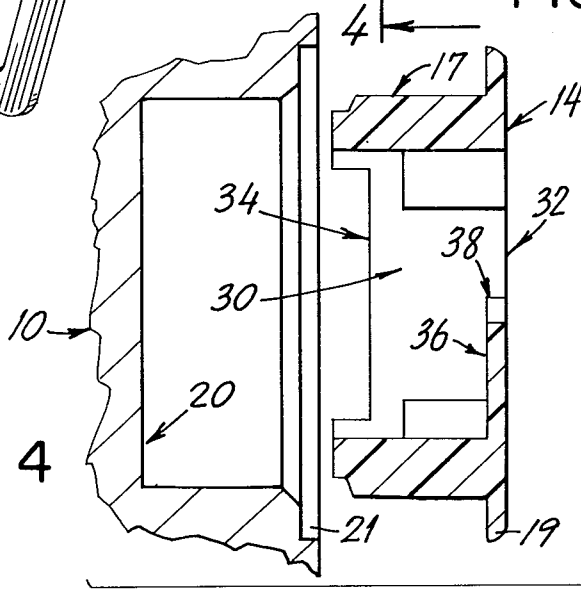
FIG. 4 illustrates the insert of FIGS. 2 and 3 in cross-section along line IV—IV in FIG. 3 in potentially cooperative arrangement with a bracing easel-type structure.

FIGS. 2–4 show the details of a hat-shaped insert 14 by way of example, and FIG. 4 particularly shows the insert 14 in potentially cooperative relationship with the bracing structure 16. From these views, it will be seen that the insert 14 includes a torroidal wall or body 17 which constitutes the crown of the hat and is adapted for being inserted into a corresponding bore 20 in the article 10. To assure that a press fit can be made between the insert 14 and the article 10, the wall or body 17 is provided with a plurality of ribs or teeth 22 of triangular or pointed cross-section whereby a tooth-like grip is effected between the insert 14 and the associated article or body 10. Moreover, the wall 17 is provided with a cut out forming shoulders 24 and 26 in turn providing for a recessed section 28. In other words, there is a step between the cut out section 28 and the balance 29 of the wall 17. The article 10 is moreover provided with a rim or brim 19 which is received in a countersunk portion 21 of hole 20. A single alignment only is preferred in a rotational or polar sense between the insert and the bore 20 into which the insert is to be positioned. This alignment is provided by the equipment and apparatus of the invention to be described hereinafter.

The wall 17 defines an interior bore 30. This bore has an entry end indicated at 32 (see FIG. 4) and an end 34 distal with respect thereto. A wall 36 closes off approximately one-half of the opening of the bore 30 at entry end 32. This permits limited access to the bore as will be explained in greater detail hereinbelow. It should be noted that the wall 36 is provided with an edge 38. The edge 38 is serrated and thus the edge 38 has a plurality of teeth such as indicated at 39. One of the purposes of these teeth is to provide for rigorous engagement with a hooking device, or the like, such that the article 10 may be provided with firm engagement with the hooking device in order to be firmly and hookingly engaged when held in suspended relationship on a vertical wall.

As appears in FIG. 4, the bracing structure 16 consists of a first section 40 and a second section 42. The first section 40 constitutes a hook-like appendage on the second section 42 to which it is attached by a root 44 and from which it is separated by means of a slot 46. The second section 42 has a longitudinal extent indicated at S which is in the order of magnitude of at least about three times the thickness T (see FIG. 1) of the article 10. This enables an adequate easel-like support to permit bracing the article 10 in upright position.

The sections 40 and 42 cooperatively constitute a key arrangement intended to engage in the key receptacle constituted by the bore 30. As seen in FIG. 3, the first section 40 is indicated at 40′ in horizontal relationship or, in other words, in parallel to the edge 38. This enables the section 40 to be inserted past the wall 36 and thus into the bore 30. Thereafter, the section 40 as well, as the section 42 by which it is manipulated, is rotated in the direction indicated by the arrow 50. The section 40 is thus rotated to the position indicated at 40″.

As the section 40 is rotated from the position indicated at 40′ to the position indicated at 40″, it moves from a horizontal posture to a vertical posture. In so doing, it first encounters walls 54 and 56. Wall 54 forms a pair with wall 58. Wall 56 forms a pair with wall 60. Collectively, these two pairs of walls form a socket device to receive the section 40 of bracing structure 16 and to lock the same in position. Wall 54 is flexible and is shorter than wall 58 in order to permit the entry of section 40 between the walls of this pair. The shorter wall 54 is upstream of the wall 58 relative to the direction of movement indicated by arrow 50. Similarly, walls 56 and 60 which are arranged in mirror image relationship with respect to walls 54 and 58 constitute a socket or locking arrangement which receives the other extremity of the section 40 as the section 40 is rotated into position in the manner indicated by arrow 50. It should be noted that the wall 36 is accommodated by slot 46 and that this section 40 is retained in the bore by operation of wall 36 as well as by socket or locking arrangements constituted by the two pairs of walls comprising walls 50, 56, 58 and 60, all as discussed hereinabove. It should also be noted that walls 56 and 60 give the internal configuration of the insert a characteristic shape (see FIG. 2) which is used in the apparatus of the invention.

Figure 5:
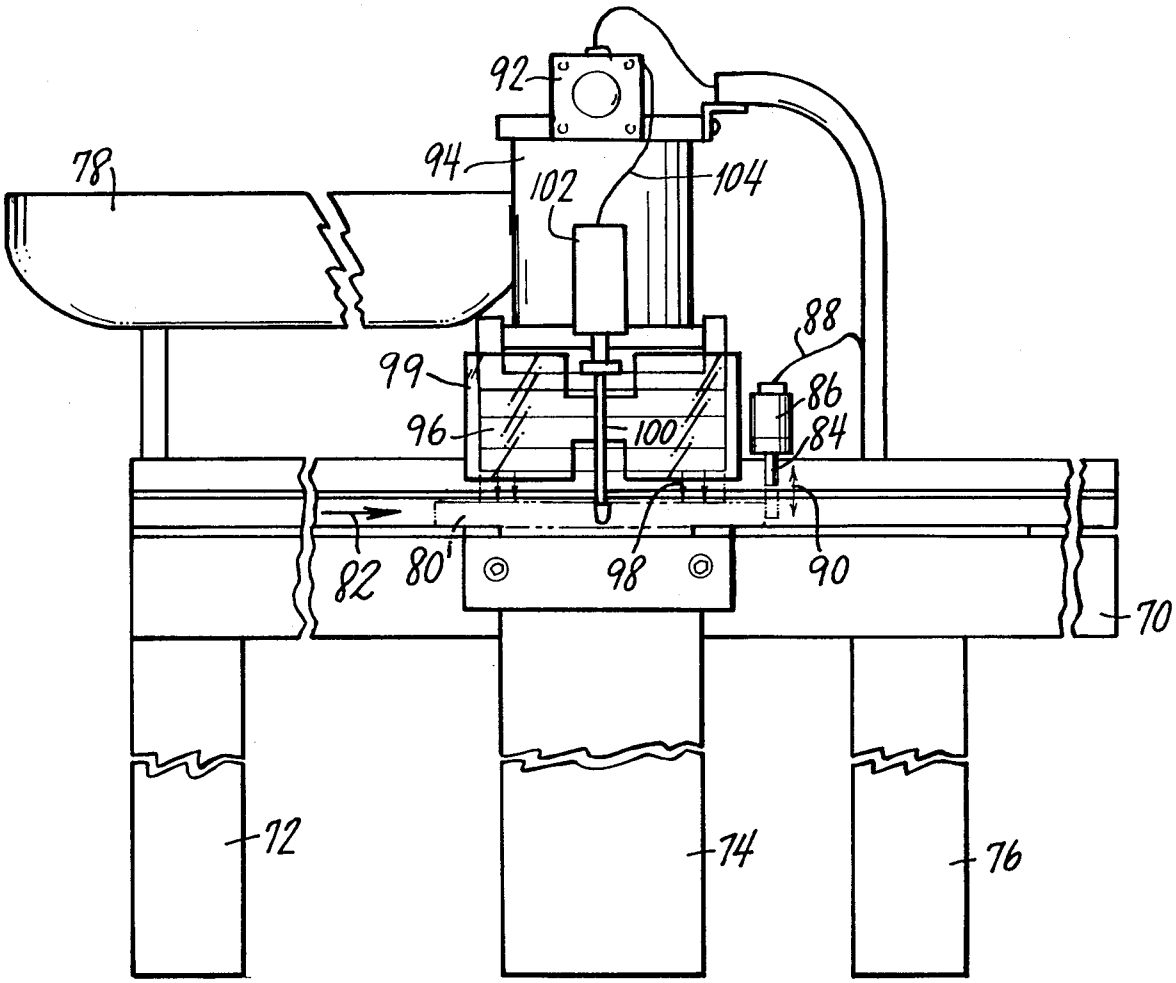
FIG. 5 is a side view of the apparatus of the invention as employed in practicing the method of the invention.

In FIG. 5 is illustrated a table 70 supported on legs 72, 74 and 76. Also illustrated in FIG. 5 is a commercially available vibrating arrangement 78, the configuration of which on the interior thereof will be described below to the extent necessary to understand the operation of the invention.

Further illustrated in FIG. 5 in phantom lines is a plaque 80 of the above-noted type. This plaque is manually inserted into the apparatus of the invention as indicated by arrow 82. It is moved against a stop 84 which is moved into position by an electromechanical device 86 controlled by a line 88. The stop 84 which cooperates with the electromechanical device 86 and forms a part thereof is movable in reciprocal directions indicated by arrow 90 between the illustrated withdrawn position and the position illustrated in phantom lines which constitutes the position in which the armature 84 operates as a stop.

Operated by a control 92 is a cylinder 94 constituting part of an electromechanical device or of a piston and cylinder arrangement whereby a component 96 is moved downwardly as indicated by arrows 98. This operation serves to hold the plaque 80 in position after it has been moved into the processing station for further operations to be described hereinbelow. A plastic shield protecting operators is indicated at 99 and a further stop mechanism is indicated at 100, the stop 100 being operated by a cylinder 102 controlled by a signal received via line 104. The operations indicated hereinabove may be manually commenced by a switching arrangement (not shown). Alternatively, the operations of the invention may be sequentially and individually controlled and initiated or controlled by programming or controlled by sensing of the completion of the various steps whereby the next sequential step in the operation is automatically begun.

Figure 6:
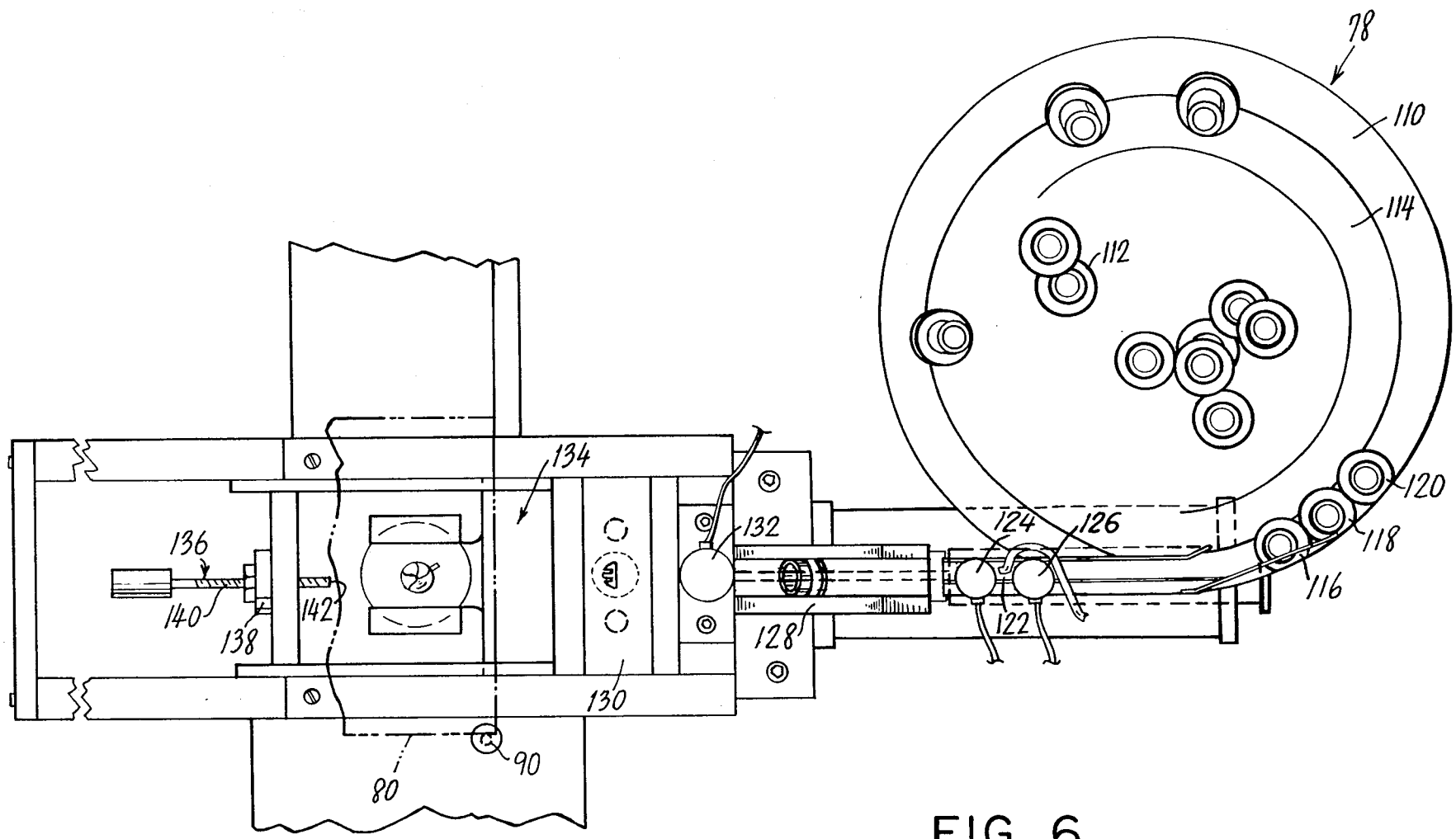
FIG. 6 is a top view of the apparatus illustrated in FIG. 5 with portions being broken away, the view being partially diagrammatic.

FIG. 6 illustrates that the vibrator 78 is in the form of a vat having a peripheral wall internally of which is mounted an upwardly spiralling path indicated at 110. The vibrator acts in conventional manner which is too well known to warrant discussion in this text to vibrate the parts or inserts 112 which are charged in great volume into the chamber 114 of the vibrator 78. Vibration of these parts or inserts causes the same to ascend along the upwardly spiralling path 110 and to be oriented therealong to be processed in a manner to be described hereinbelow. Parts which have been raised to the upper portion of the spiral path 10 are indicated generally at 116, 118 and 120. These parts continue along a tangential path indicated at 122 whereat they are stopped by a piston and cylinder arrangement 124 and isolated by a piston and cylinder arrangement 126 installed in tandem with piston andcylinder arrangement 124 and to be discussed in greater detail hereinbelow. The parts subsequently passed to a chute 128 and thereafter to a slide arrangement 130 to be installed thereon by a piston and cylinder arrangement 132 thereafter to be conveyed to the processing station generally indicated at 134 whereat is located the plaque 80 which is halted during its manual insertion into the system by, for example, the stop 90. A stop 136 which is installed in a block 138 is adjustable due to its threadable engagement by the threading 140. The end 142 of the stop limits the penetration of the slide 132 as will be discussed in greater detail hereinbelow.

Figure 7:
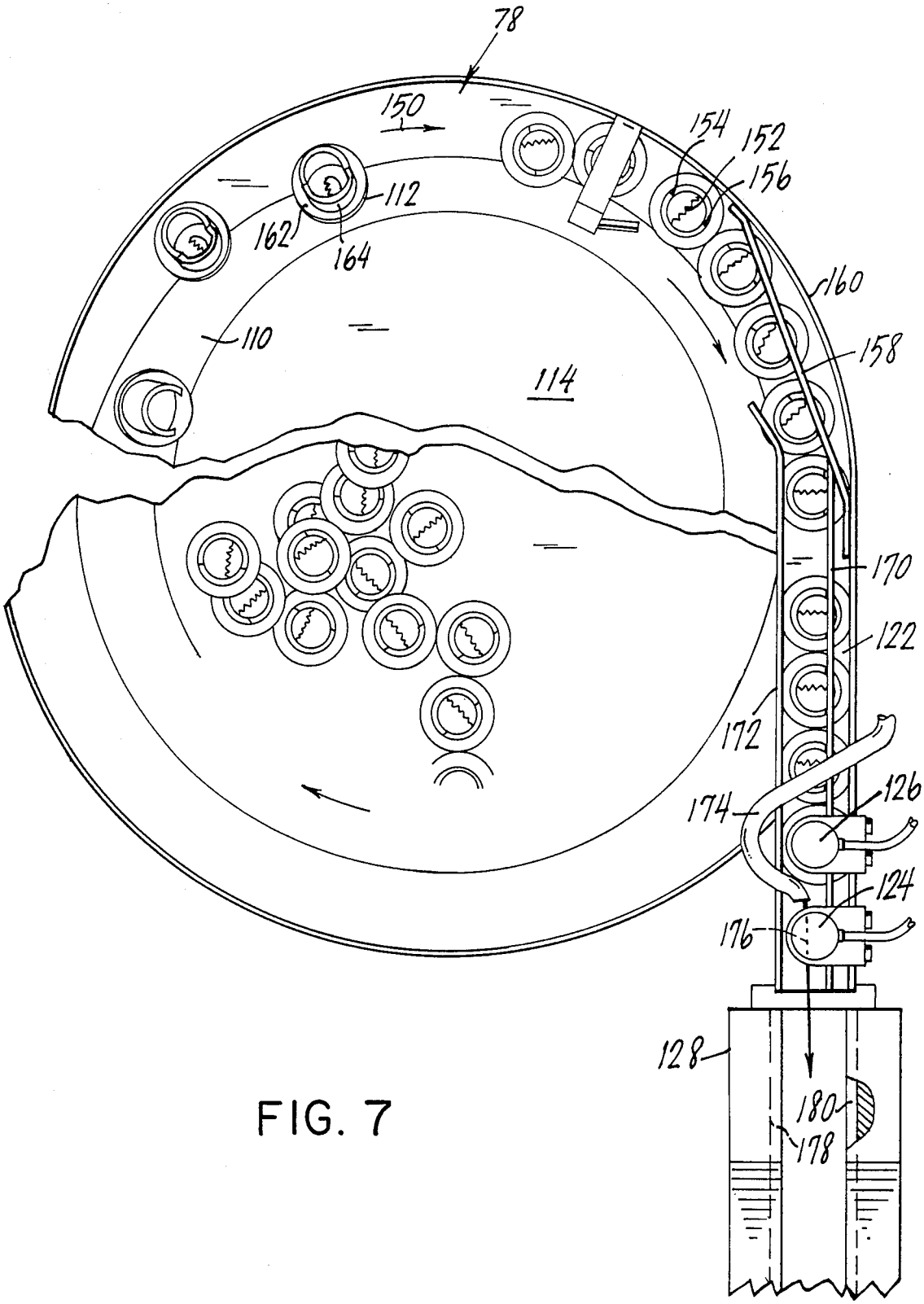
FIG. 7 is a view of a portion of FIG. 6 on enlarged scale.

FIG. 7 again illustrates the vibrator 78 with the parts 112 being displaced in a direction indicated by arrow 150 upwardly along the upwardly spiralling path 110. The parts or inserts 112 are each of identical configuration having a serrated edge indicated at 152 and discussed in detail hereinabove This edge is a chordal edge and has a perpendicular relationship to the shoulders 154 and 156 also discussed in detail with respect to FIGS. 2–4. To engage the shoulders 154 and 156 of the respective parts is a positioning and culling rail arrangement 158 installed on peripheral wall 160 of the arrangement and superposed above the path along which the parts are travelling. The rail 158 is installed at such a height as to able to engage the shoulders 154 and 156. If these shoulders are aligned with the rail, the part is accepted and passes on to the tangential path 122. If the shoulders are slightly displaced relative to the rail 158, the associated part will be slightly rotated and the part will be generally accepted. If the shoulders are greatly displaced relative to the rail 158, or if the part 112 in question is inverted such that the brim 162 thereof is upwardly directed and the crown 164 is downwardly directed, the part will be dislodged from the spiral path and will tumble down into the central chamber 114 of the vibrator 78 to be further vibrated and driven up along the spiral path until ultimately it is accepted and passes down the tangential path under the further supervision and pressure of guide rails 170 and 172 which are installed above and along the tangential path 122.

Next coming into play are the piston and cylinder arrangements 124 and 126 respectively. Associated with the piston and cylinder arrangement 124 is an air jet hose 174 capable of directing the foremost part downwardly along path 176 into the chute 128 which is provided with slots 178 and 180 whereby diametrically opposed portions of the brim 162 of the part or insert in question are received for downward movement along the chute as will next be described hereinbelow.

Figure 8B:
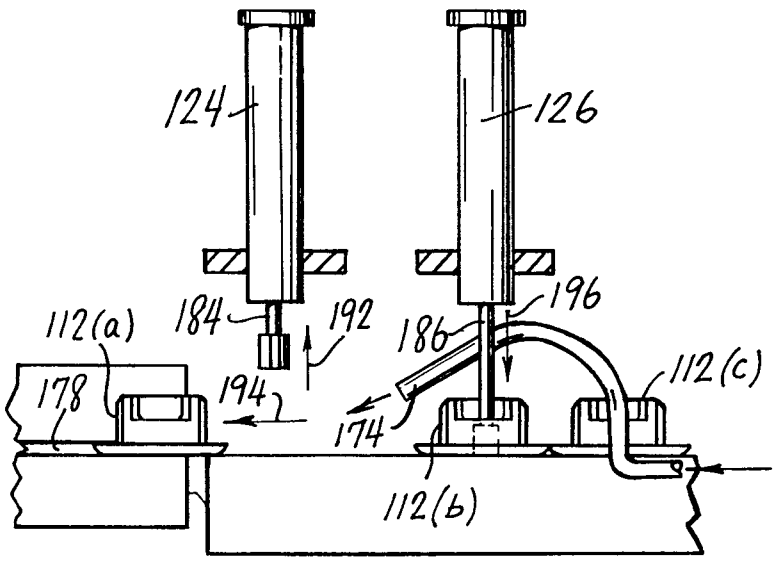
FIGS. 8(*a*) and 8(*b*) show on enlarged scale and in respective sequential operations a portion of the apparatus of FIG. 7 at the juncture of the vibrator and chute to show the transfer of inserts therebetween.
Figure 8A:
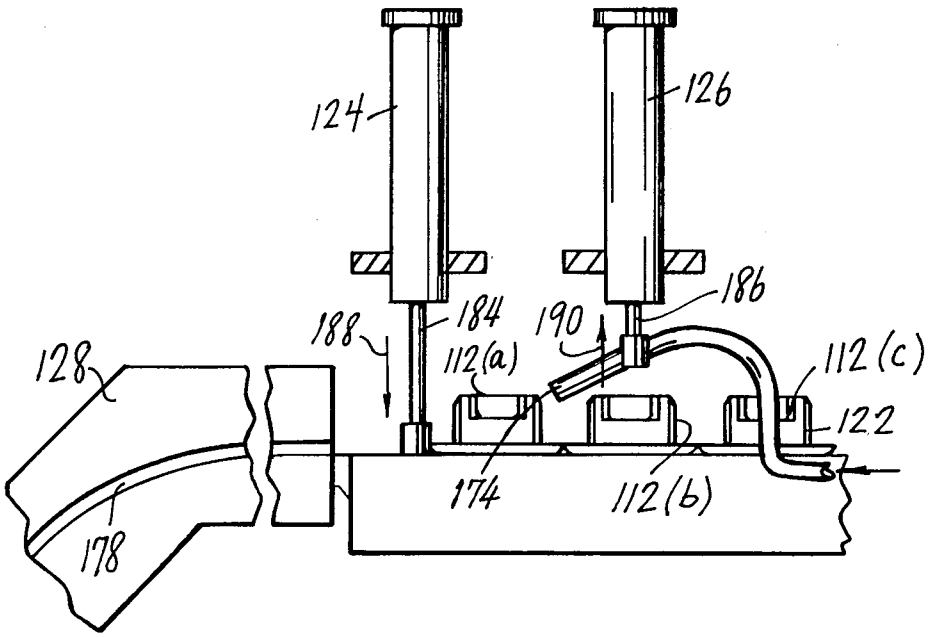

FIGS. 8(*a*) and 8(*b*) illustrate the operation of piston and cylinder arrangements 124 and 126. In this figure, it can be seen that a piston rod 184 extends downwardly into a position of interference with the foremost insert 112(*a*) whereas at this time piston rod 186 is withdrawn from a position of interference and is retracted into the associated cylinder. The movements bringing these piston rods into position are indicated respectively by arrows 188 and 190. The next sequential insert is indicated in position 112(*b*) and the third sequential insert on the tangential path or runway 122 is indicated at 112(*c*). The chute 128 with one of its grooves 178 is also indicated in this figure.

In the next sequential operation as illustrated in FIG. 8(*b*), it is indicated that the piston rod 184 is withdrawn as shown by arrow 192, thereby releasing the part 112(*a*) to be moved by the force of the jet issuing from hose 174 along the path indicated by arrow 194. Thereby the part 112(*a*) moves into the chute with the brim of the part being accommodated in the groove or slot 178 (as well as in the groove 180) whereby the part 112(*a*) may pass under gravitational forces to the slide arrangement as will be described in greater detail hereinbelow.

At the same time, the rod 186 moves downwardly as shown by arrow 196 thereby to engage the part 112(*b*) to prevent the same from being moved in trailing relationship with part 112(*a*) so that an attempt to bring two parts simultaneously to the slide arrangement is prevented. However, at an appropriate time thereafter, the rod 184 moves downwardly to the position illustrated in FIG. 8(*a*) and rod 186 is withdrawn thereby enabling part 112(*b*) to move into foremost position preparatory to being moved into the chute whereas part 112(*c*) moves into the second position under cylinder and piston arrangement 126 so that the movement and the process indicated in FIG. 8(*a*) can be repeated.

Figures 9A, 9B:
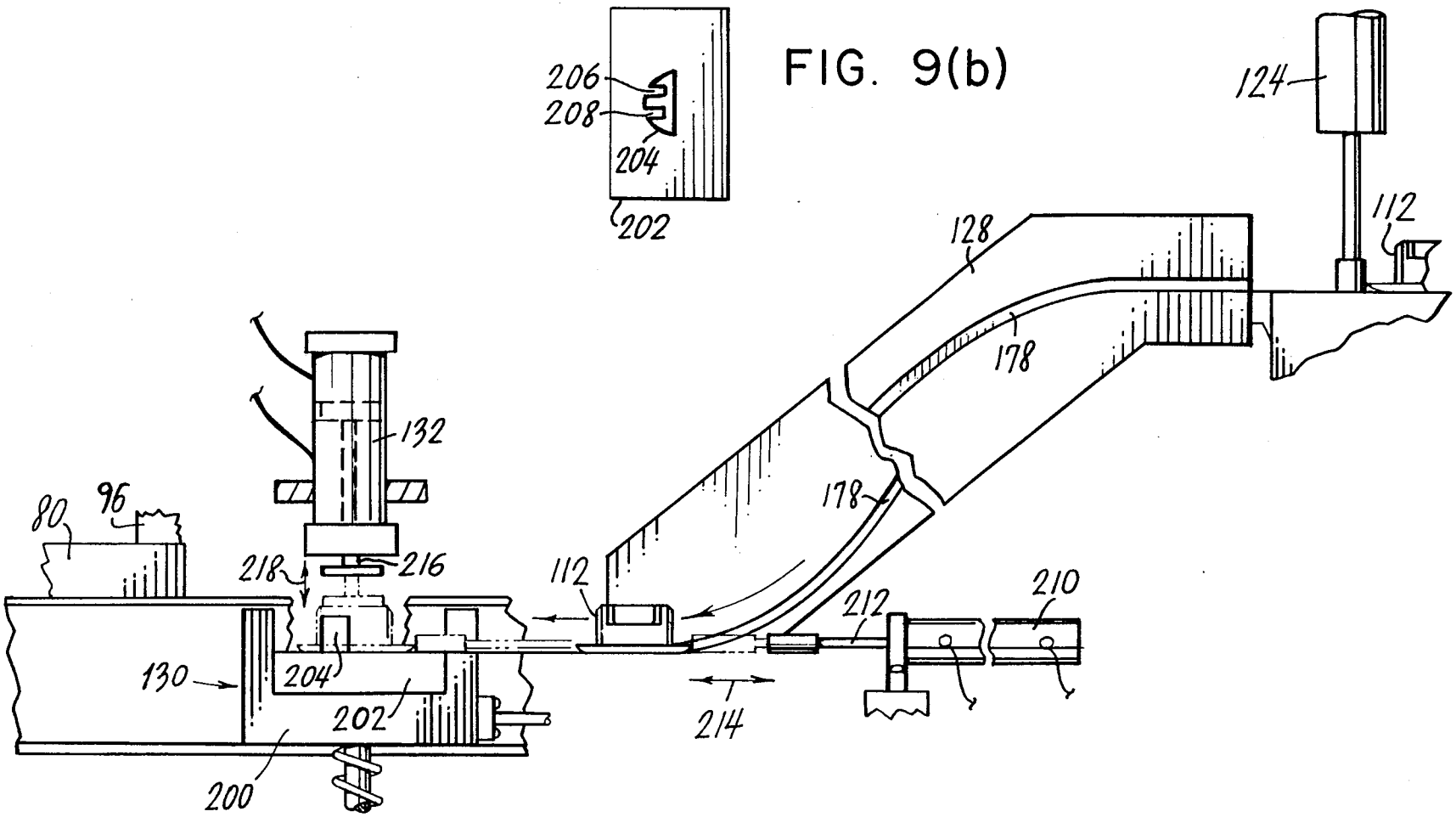
FIG. 9(*a*) shows on enlarged scale a portion of the apparatus including the chute and a slot arrangement to show the transfer of an insert from the vibrator via the chute to the slide arrangement of the invention.

The sinusoidal shape of the grooves 178 and 180 is illustrated in FIG. 9(*a*) wherein is seen the disposition of the chute 128. Piston and cylinder arrangement 124 is also illustrated in this figure along with the next sequential part 112 to be processed. In FIG. 9(*a*) furthermore appears the slide arrangement 130. This slide arrangement includes a base 200 with a member 202 upwardly displaceable therefrom. This upwardly movable member includes a projection 204, the details of which appear in somewhat diagrammatic form in FIG. 9(*b*). Therein it appears that the projection 204 on member 202 is of a generally cylindrical form provided with slots 206 and 208. With reference to FIGS. 2–4, it will be appreciated that these two slots are intended to receive walls 56, 60, so that a rigorous orientation of the insert relative to the projection 204 is thus assured. This, in turn, assures a rigorous orientation of the insert relative to the slide arrangement and thus relative to the plaque into which the insert is to be installed. This furthermore assures a rigorous orientation of the edge 38 (see FIG. 2) relative to the edge of the plaque with which the process is to be concerned (see edge 10' in FIG. 1).

As will be explained in greater detail hereinafter, the installation of a part or insert 112 or a transference of the same from the chute 128 to the slide arrangement 130 is effected by the provision of a piston and cylinder arrangement 210 and a further piston and cylinder arrangement 132 as has been mentioned above. The arrangement 210 includes a rod 212 which is reciprocal in the direction indicated by arrow 214, thereby to engage the part 112 and displace the same to a position beneath piston and cylinder arrangement 132. The relative postures of piston and cylinder arrangements 132 and 210 are illustrated with greater accuracy in figures to be discussed below. Herein it it sufficient to note that insert 112 is moved to a position between the piston and cylinder arrangement 132 to be engaged by a rod 216 which is reciprocal as shown by arrows 218 thereby to thrust the part 112 downwardly onto projection 204 so that the insert or part is held firmly in position to be inserted into plaque 80 which is being held down in position by the component 96 which has been mentioned hereinabove. FIG. 9(*a*) furthermore illustrates that arrangement whereby the member 202 tends to seat on slide 200. This arrangement will be discussed in greater detail hereinbelow.

Figure 10A:
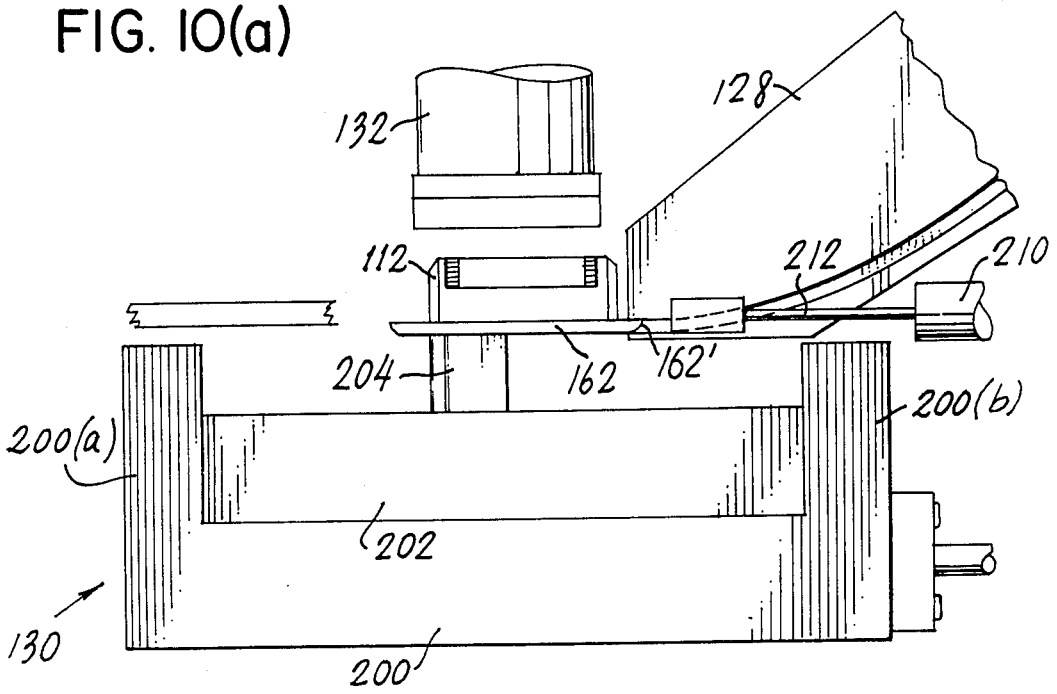
FIGS. 10(*a*) and 10(*b*) respectively show an arrangement whereby the insert is engaged with the projection of the slide arrangement of FIGS. 9(*a*) and 9(*b*)
Figure 10B:
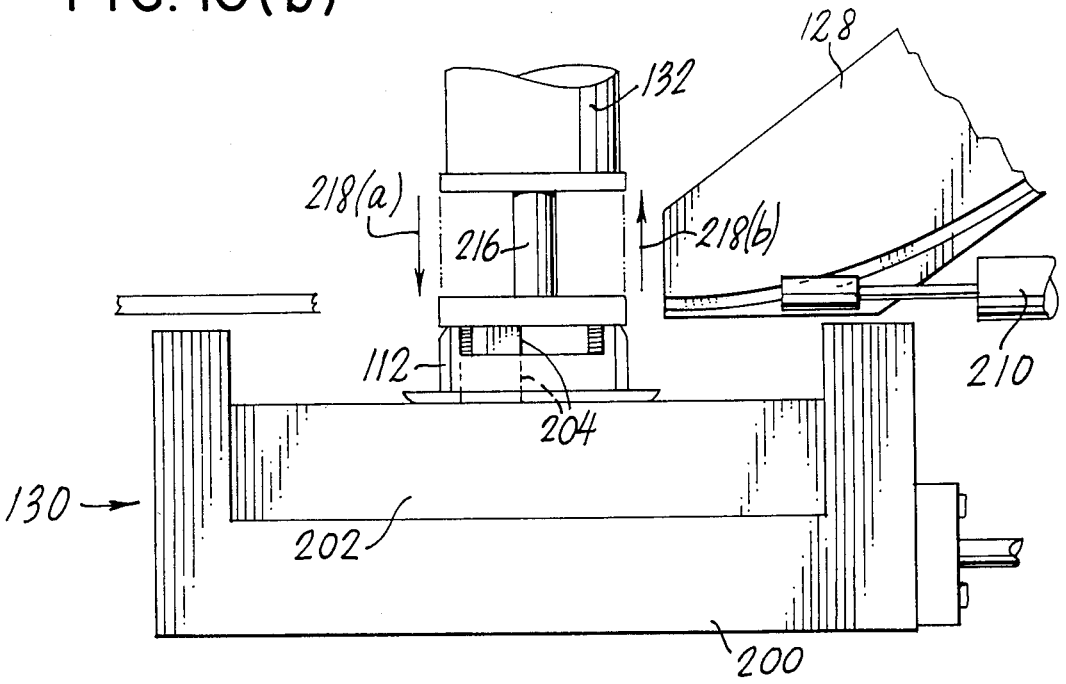

FIGS. 10(*a*) and 10(*b*) illustrate on enlarged scale the slide arrangement 130 and the two-cycle operation of the piston and cylinder arrangement 132 in cooperation with the piston and cylinder arrangement 210. In this figure can be seen the base 200 with upstanding guidewalls 200(*a*) and 200(*b*). Also seen is the displaceable member 202 with the projection 204 thereupon. In FIG. 10(*a*) it can be seen that the trailing portion of the rim is still within the chute 128, the brim being indicated at 162 and the trailing portion thereof being indicated at 162'. Engagement has not yet been made by the rod 212 and the part 112 sits above the projection 204. In FIG. 10(*b*) are indicated arrows 218(*a*) and 218(*b*) showing the descending and ascending strokes of the rod 216. By virtue of the descending stroke 218(*a*), the part 112 is forced down onto the projection 204, the parts having been, as discussed above, previously oriented such that projection 204 is engaged within the opening in part 112. As noted above, these parts have corresponding male-female conformations enabling a matching fit and thereby assuring orientation of the insert 112 in the plaque and relative to the plaque with which it is to be associated.

Figure 11:
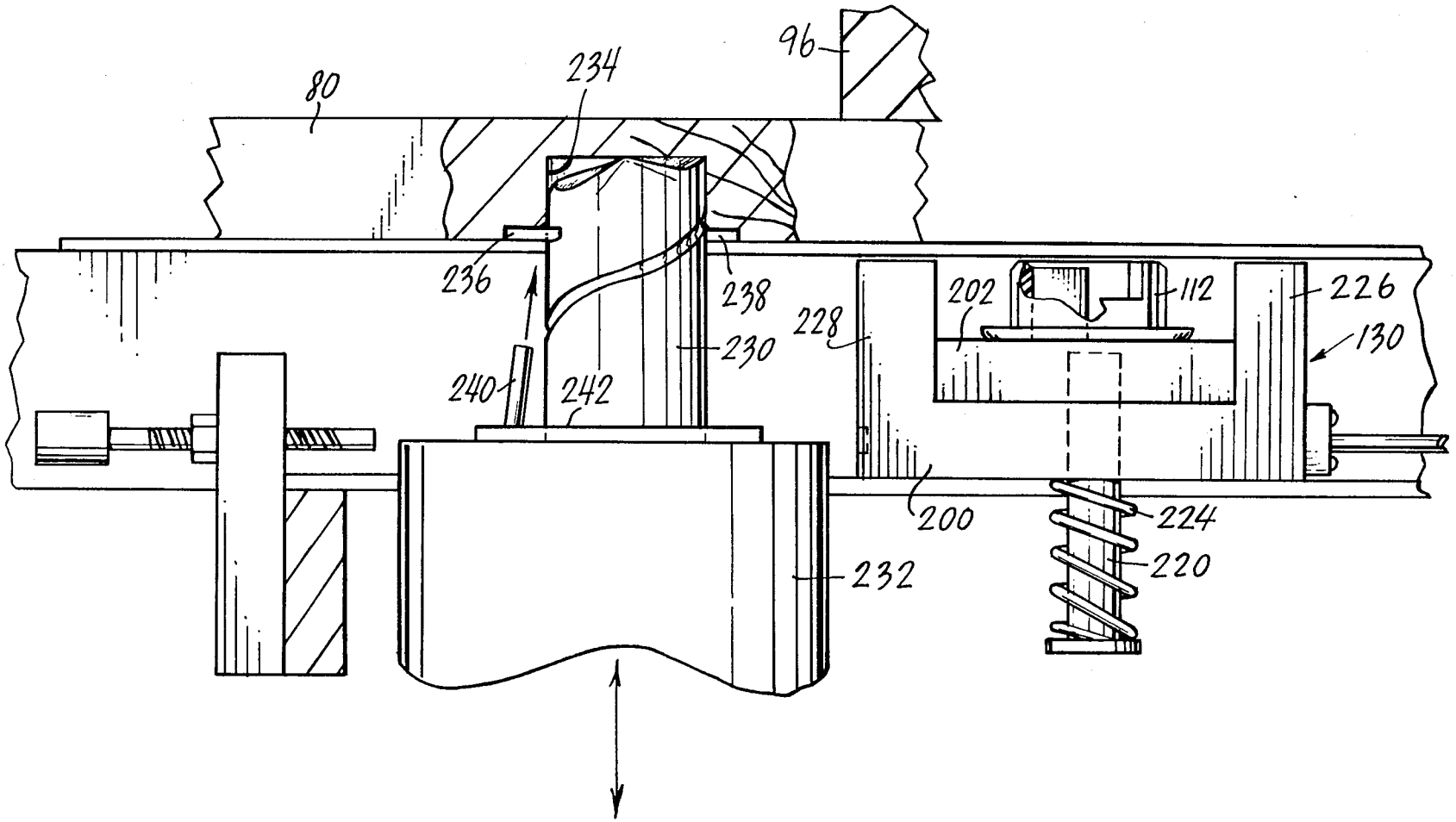
FIG. 11 illustrates the drilling of a hole in a plaque, this view being of a side view of a drill and bit arrangement viewed with the slide arrangement adjacent the same.

FIG. 11 illustrates a plaque 80 in its processing station being held down in this station by component 96. Also illustrated is the slide arrangement 130 with an insert 112 being mounted thereupon in a manner which has been discussed above. It will be seen in this figure that attached to the part 202 superposed on base 200 is a pair of pins, one of which is indicated at 220. This pin has a head 222 which sandwiches a compression spring 224 against the base 200. Thereby the part or member 202 is urged to be seated against the base 200. The spring 224, however, allows displacement of the component 202 upwardly away from the base 200 as guided by lateral guidewalls 226 and 228.

Also appearing in FIG. 11 is the drill bit 230 and the drill barrel 232 constituting a drilling arrangement by means of which a hole 234 may be drilled in the plaque 80. A routing member 236 encircles the bit 234 and provides for countersinking a hole 238 in encircling relationship to the hole 234. This enables accommodation of the brims of the various inserts as they are forced into their respective holes.

Also appearing in FIG. 11 is an air jet hose 240. This air jet hose provides for ejecting blasts of air into the holes 234 after they are drilled thereby enabling a cleaning out of the same. This prevents trapping excess and waste materials in the hole thereby to permit an appropriate seating of the appropriate inserts in their related holes in the associated plaques as the mass production process of the invention takes place.

Figure 12:
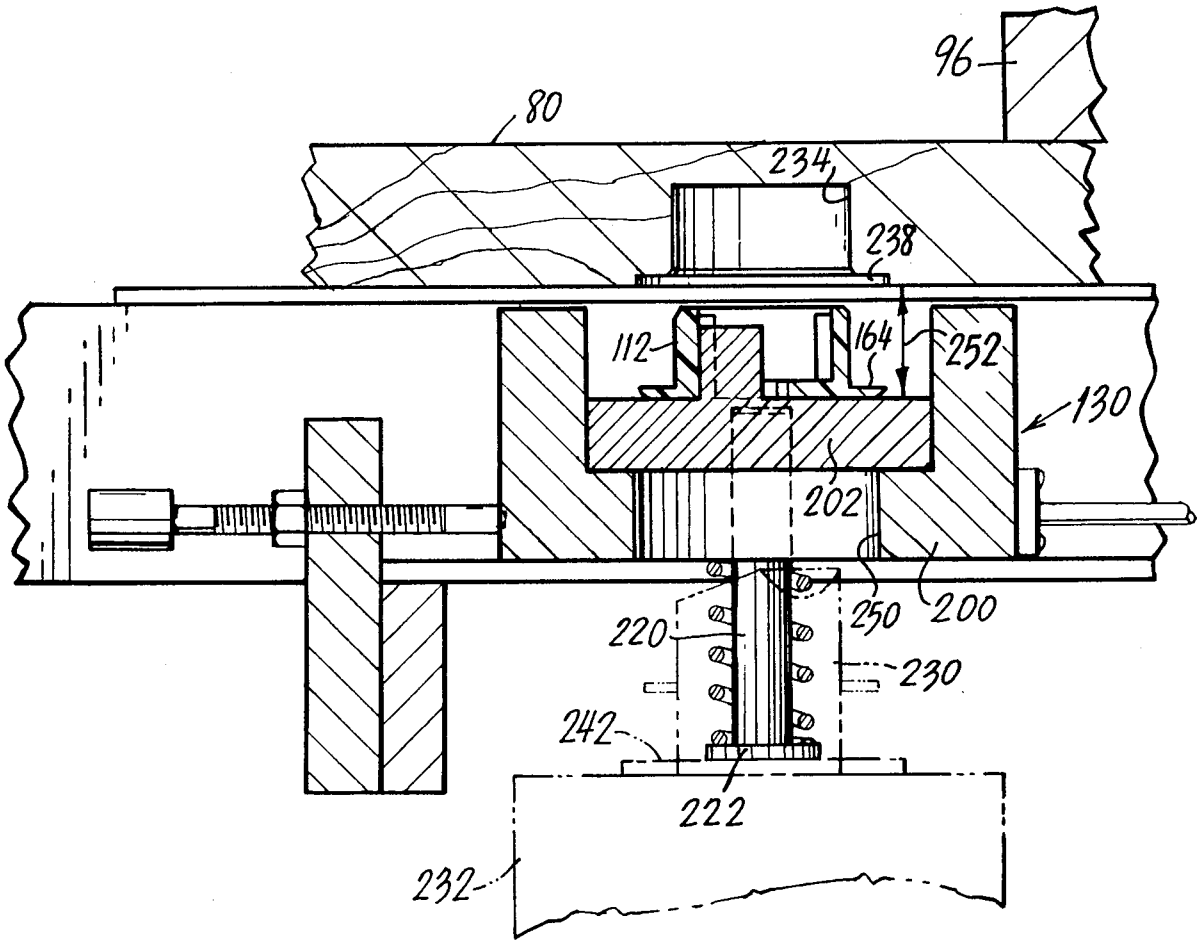
FIG. 12 illustrates the cycle subsequent to the drilling cycle wherein the insert is forced by the drilling arrangement into a hole which has been drilled into a plaque in accordance with the foregoing.

Shoulders 242 straddle the bit 234. These shoulders are effective during a subsequent cycle of operation of the drilling arrangement of the invention. As shown in FIG. 12, the shoulders 242 engage the heads 222 of the respective pins, thereby displacing member 202 upwardly and forcing insert 112 into its hole 234. Brim 164 is accommodated in countersunk hole 238, thereby enabling the lower edge of the insert (as illustrated in FIG. 12) to be flush with the lower surface of the plaque 80. This enables a stacking of these plaques with adjoining faces of the same being in face-to-face contiguous relationship to avoid in turn an upsetting of the stack as it is being formed.

With reference to FIG. 12, and what has been stated hereinabove, it will be understood that the operation of the barrel 232 and bit 230 is a two-cycle operation. In the first cycle of operation, the slide arrangement 130 is withdrawn and the drill bit 230 is free to travel through a hole 250 provided in base 200 to drill a hole 234 in the plaque 80 which is located at the processing station. However, during a second cycle, the slide arrangement 130 is moved into intervening relationship between the drill arrangement and the hole 234 which has just been drilled and the pins 220 are engaged by the shoulders 242. This causes the member 220 with the insert 112 thereupon to be displaced upwardly as indicated by arrow 252 and the insert 112 is then pressed or force fed into the opening 234 with the brim 164 being accommodated in the countersunk portion 238. It will thus be appreciated that the invention provides a method for mounting an insert in a plaque or plaque-like body which method comprises holding the body in a processing station reciprocating a drilling tool towards and away from the body in first and second cycles, drilling a hole in the body during the first cycle, moving the insert into a position between the hole and drilling tool upon withdrawal of the tool from the hole and pressing the insert into the hole by means of the tool during the second cycle.

It is to be understood that the insert 14 is a monolithic plastic construction formed of a suitable plastic of commercially available type. It is also to be understood that the insert may be automatically installed into the article 10 or the like by an automatic installation device employing mass production techniques.

The invention involves the mounting of the above insert into a planar structure or body, which insert comprises a body defining a cylinder bore or the functional equivalent thereof having an entry end and including a wall closing off a part of the entry end to leave a limited access into the bore. The insert further includes the walls 54, 56, 58 and 60 to receive a brace which is inserted through the access opening. This section is thereafter rotated to be received by the locking arrangement formed by the aforesaid walls. By "offset" relationship as mentioned hereinabove, reference is made to the relationship of the edge 38 which is illustrated as being horizontal and the arrangement of the walls 54, 56, 58 and 60 which are spaced parallel members arranged in vertical attitude. It is also to be noted that the edge 38 has a predetermined desired relationship with the top edge 10' of body 10 which in the illustrated case is a parallel relationship. This relationship is also achieved by the apparatus and method of the invention.

There will now be obvious to those skilled in the art many modifications and variations of the structures set forth hereinabove. These modifications and variations will not depart from the scope of the invention if defined by the following claims.

What is claimed is:

1. Apparatus for automatically placing an insert in a body comprising support means for supporting said body at a processing station, drill means reciprocal towards and away from said body at said processing station for drilling a hole in said body, and slide means reciprocal between positions respectively intervening between the drill means and the body at the processing station and removed therefrom, said slide means being adapted to support said insert and being adapted to be at least in part displaced by said drill means to move the insert into said hole whereby on sequential movements said drill means drills a hole in said body and then moves the insert into the hole.

2. Apparatus as claimed in claim 1 wherein said slide means includes a base, a member displaceable from said base upon pressure from said drill means, and return means to return said member to said base.

3. Apparatus as claimed in claim 2 wherein said member includes pins extending slidably through said base and said return means include compression springs on said pins.

4. Apparatus as claimed in claim 3 wherein said pins include heads sandwiching the springs against said base.

5. Apparatus as claimed in claim 3 wherein said drill means includes a bit, a barrel supporting said bit, and shoulders on said barrel on opposite sides of said bit for engaging said pins.

6. Apparatus as claimed in claim 2 wherein said insert defines an opening and said member includes a projection, said projection and opening being at least in part of matching male and female configuration.

7. Apparatus as claimed in claim 2 comprising air jet means adjacent said bit for cleaning out said hole.

8. Apparatus as claimed in claim 2 comprising a track for guiding said base, and piston and cylinder means for reciprocating said base and thereby said slide means between said positions.

9. Apparatus as claimed in claim 8 comprising adjustable stop means for limiting movement of said slide means.

10. Apparatus as claimed in claim 5 wherein said base is provided with a hole to accommodate passage therethrough of said bit when the slide means intervenes between said body and drill means.

11. Apparatus as claimed in claim 1 comprising delivery means for delivery of said insert to said member with said opening oriented with said projection, and piston and cylinder means to force the insert onto said projection.

12. Apparatus as claimed in claim 11 wherein said insert is configured as a hat including a brim and a crown, said delivery means including a chute provided with slots to receive diametrically opposed portions of said brim.

13. Apparatus as claimed in claim 12, said crown and brim having an opening which is partly covered to form a chordal edge, said crown being partly cut out to leave a shoulder having an angular relationship to said edge, wherein said delivery means includes a culling rail means upstream of said chute to allow said insert to pass when appropriately oriented and to reject the insert when it is not appropriately oriented.

14. Apparatus as claimed in claim 13 wherein said delivery means comprises vibrating means including a vat chargeable with a plurality of inserts and an upwardly inclined spiral path in the vat along which said plurality of inserts, identical with the first said insert, are directed in crown up, brim down posture, said spiral path terminating in a tangential path passing beneath said culling rail means which is thereby effective to pass and reject said inserts according to the posture thereof.

15. Apparatus as claimed in claim 14 comprising air jet means to urge the inserts against said culling rail means whereby the inserts are passed or rejected or urged into passable orientation by orienting the shoulders of the inserts with respect to the culling rail means.

16. Apparatus as claimed in claim 14 comprising alternately operable piston and cylinder means spaced along said tangential path to block said inserts and to release the foremost insert for movement into and through said chute respectively.

17. Apparatus as claimed in claim 14 comprising piston and cylinder means at the downstream end of the chute to position each insert relative to said slide means.

18. Apparatus as claimed in claim 12 wherein the slots of said chute are sinusoidal in configuration.

19. Apparatus as claimed in claim 6 wherein said projection has a configuration which is part of a cylinder with slots therein to receive corresponding parts of the insert.

20. A method for mounting an insert in a plaque-like body, said method comprising holding said body in a processing station, reciprocating a drilling tool towards and away from said body in first and second cycles, drilling a hole in said body during the first cycle, moving the insert into a position between the hole and drilling tool upon withdrawal of the tool from the hole, and pressing the insert into the hole by means of said tool during the second cycle.

21. A method as claimed in claim 20 comprising repeating the method sequentially for a plurality of bodies and inserts.

22. A method as claimed in claim 21 comprising vibrating the bodies to orient the same for substantially identical insertion into respective of said bodies.

23. A method as claimed in claim 22 comprising feeding the inserts along an upwardly spiralling path while vibrating and orienting the same and culling out any non-oriented inserts before an attempt is made to mount the same in a body.

* * * * *